US010703547B2

(12) United States Patent
Filho et al.

(10) Patent No.: US 10,703,547 B2
(45) Date of Patent: Jul. 7, 2020

(54) CLOSURE CAPS

(71) Applicant: GREIF INTERNATIONAL HOLDING BV, Amstelveen (NL)

(72) Inventors: Diogo Toshikasu Kitaoka Filho, Curitiba (BR); Pedro Miguel De Oliveira, Curitiba (BR)

(73) Assignee: GREIF INTERNATIONAL HOLDING BV, Amstelveen (NL)

( * ) Notice: Subject to any disclaimer, the term of this patent is extended or adjusted under 35 U.S.C. 154(b) by 262 days.

(21) Appl. No.: 15/567,582

(22) PCT Filed: Apr. 19, 2016

(86) PCT No.: PCT/EP2016/058675
§ 371 (c)(1),
(2) Date: Oct. 18, 2017

(87) PCT Pub. No.: WO2016/169934
PCT Pub. Date: Oct. 27, 2016

(65) Prior Publication Data

US 2018/0290800 A1 Oct. 11, 2018

(30) Foreign Application Priority Data

Apr. 20, 2015 (GB) ..... 1506691.3

(51) Int. Cl.
*B65D 39/00* (2006.01)
*B65D 51/18* (2006.01)
(Continued)

(52) U.S. Cl.
CPC ..... *B65D 55/0863* (2013.01); *B65D 51/18* (2013.01); *B65D 39/08* (2013.01);
(Continued)

(58) Field of Classification Search
CPC .... B65D 55/0863; B65D 51/18; B65D 51/20; B65D 2251/0015; B65D 2251/0075;
(Continued)

(56) References Cited

U.S. PATENT DOCUMENTS 1,276,768 A * 8/1918 Hoyle ..... B65D 39/084 220/259.4
1,656,228 A * 1/1928 Parish ..... B65D 39/084 220/257.1
(Continued)

FOREIGN PATENT DOCUMENTS

CN 1738749 A 2/2006
CN 1816480 A 8/2006
(Continued)

*Primary Examiner* — Gideon R Weinerth
(74) *Attorney, Agent, or Firm* — Baker & Hostetler LLP

(57) ABSTRACT

A tamper indicating preassembly or kit of parts is provided for protection of a container closure plug receivable in a container opening having a groove or recess formed thereabout. A support ring comprises a radially inwardly directed lip engageable in the groove or recess. A masking membrane may be sealed at its periphery to the support ring. The support ring may further comprise a frangibly attached, inwardly extending, flange or projection. When the plug is received in the container opening and the support ring lip is received in the container opening groove or recess, the masking membrane covers up an upper end of the plug and/or the inwardly extending flange or projection overlaps the upper end of the plug. A protective outer cover may also be provided.

8 Claims, 10 Drawing Sheets

(51) Int. Cl.

| | |
|---|---|
| ***B65D 41/62*** | (2006.01) |
| ***B65D 55/08*** | (2006.01) |
| *B65D 39/08* | (2006.01) |
| *B65D 41/48* | (2006.01) |
| *B65D 41/58* | (2006.01) |

(52) U.S. Cl.
CPC ..... *B65D 39/082* (2013.01); *B65D 39/086* (2013.01); *B65D 41/48* (2013.01); *B65D 41/58* (2013.01); *B65D 2251/0015* (2013.01); *B65D 2251/0075* (2013.01)

(58) Field of Classification Search
CPC .... B65D 2251/0012; B65D 2251/0078; B65D 2251/0087; B65D 39/08; B65D 39/0827; B65D 39/082; B65D 39/086; B65D 39/084; B65D 39/088; B65D 41/62; B65D 41/40; B65D 41/46; B65D 41/58; B65D 41/16; B65D 41/48; B65D 2101/00; B65D 2101/0023; B65D 2101/003; B65D 2101/0038; B65D 2101/0076; B65D 55/024
USPC ..... 220/257.1, 288, 254.8, 259.4, 323, 601, 220/226, 661, 257.2, 319; 215/254, 272, 215/249, 256; 222/153.06, 546, 562
See application file for complete search history.

(56) References Cited

U.S. PATENT DOCUMENTS

| | | | | | |
|---|---|---|---|---|---|
| 1,845,078 | A * | 2/1932 | Draper | B65D 39/082 | 220/257.1 |
| 1,901,196 | A * | 3/1933 | Shera | B65D 39/084 | 220/284 |
| 1,982,144 | A * | 11/1934 | Shera | B65D 39/084 | 220/257.1 |
| 1,982,806 | A * | 12/1934 | Hayes | B65D 45/30 | 217/114 |
| 2,293,943 | A * | 8/1942 | Merker | B65D 39/082 | 285/89 |
| 2,524,364 | A * | 10/1950 | Smith | B65D 51/2871 | 206/222 |
| 2,760,671 | A * | 8/1956 | Parish, Jr. | B65D 39/084 | 220/257.2 |
| 2,784,865 | A * | 3/1957 | Rieke | B65D 51/1688 | 220/258.5 |
| 3,099,364 | A * | 7/1963 | Todd | B65D 39/082 | 220/235 |
| 3,122,261 | A * | 2/1964 | Parish, Jr. | B65D 39/084 | 220/257.1 |
| 3,684,125 | A * | 8/1972 | Laurizio | B65D 39/084 | 220/276 |
| 3,792,794 | A * | 2/1974 | Cutter | B65D 51/002 | 215/247 |
| 3,987,929 | A * | 10/1976 | Mineo | B65D 39/082 | 220/257.1 |
| 4,004,709 | A * | 1/1977 | Simkus | B65D 39/084 | 220/257.1 |
| 4,111,331 | A * | 9/1978 | Summers | B65D 47/063 | 215/274 |
| 4,114,779 | A * | 9/1978 | Stoll, III | B65D 39/084 | 220/254.8 |
| RE29,850 | E * | 11/1978 | Labarre | B65D 47/103 | 215/253 |
| 4,164,304 | A * | 8/1979 | Roberson | B65D 39/084 | 220/214 |
| 4,251,003 | A * | 2/1981 | Bodenmann | B65D 55/02 | 215/254 |
| 4,516,684 | A * | 5/1985 | Walter | B65D 55/0863 | 215/272 |
| 4,573,598 | A | 3/1986 | Perry | | |
| 4,701,089 | A * | 10/1987 | Nettel | F16B 37/14 | 411/373 |
| 4,706,836 | A * | 11/1987 | Greck | B65D 39/084 | 220/259.4 |
| 4,796,769 | A * | 1/1989 | Obadia | B65D 47/12 | 215/232 |
| 4,817,807 | A * | 4/1989 | Hummer | B65D 51/20 | 215/253 |
| 5,048,706 | A | 9/1991 | deVaujany | | |
| 5,065,883 | A | 11/1991 | Udell | | |
| 5,184,747 | A * | 2/1993 | Nolte | B65D 39/082 | 220/214 |
| 5,269,429 | A * | 12/1993 | Schumacher | B65D 51/002 | 215/249 |
| 5,996,833 | A | 12/1999 | Lencioni et al. | | |
| 6,360,908 | B1 * | 3/2002 | Kline | B65D 51/18 | 220/257.1 |
| 6,637,176 | B1 * | 10/2003 | Krall | B65D 41/20 | 53/420 |
| 6,655,553 | B2 | 12/2003 | Staniszewski et al. | | |
| 6,968,968 | B2 * | 11/2005 | Buckley | B65D 39/08 | 206/459.1 |
| 7,222,741 | B2 * | 5/2007 | Chmela | B65D 51/18 | 215/252 |
| 7,568,585 | B2 * | 8/2009 | Baughman | B65D 39/088 | 215/254 |
| 7,832,579 | B2 | 11/2010 | Lohrman et al. | | |
| 9,371,161 | B2 * | 6/2016 | Rudy | B65D 41/16 | |
| 9,382,044 | B2 * | 7/2016 | Chanas | B65D 41/48 | |
| 2010/0089862 | A1 * | 4/2010 | Schmitt | B65D 51/002 | 215/249 |

FOREIGN PATENT DOCUMENTS

| | | | |
|---|---|---|---|
| EP | 0 358 583 | A1 | 3/1990 |
| EP | 1692046 | B1 | 9/2007 |
| WO | 2005/056411 | A1 | 6/2005 |
| WO | 2005/056412 | A1 | 6/2005 |
| WO | 2008/064827 | A2 | 6/2008 |
| WO | 2008/139196 | A1 | 11/2008 |
| WO | 2009/020983 | A1 | 2/2009 |

* cited by examiner

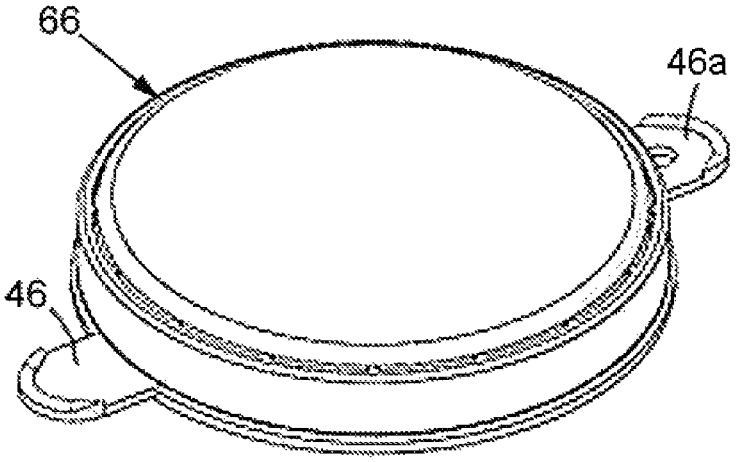
Fig. 4
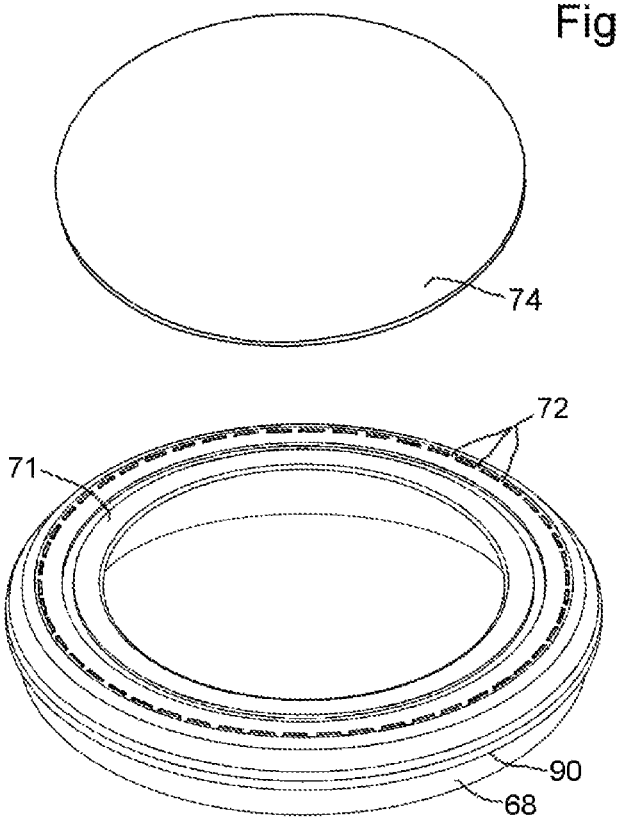

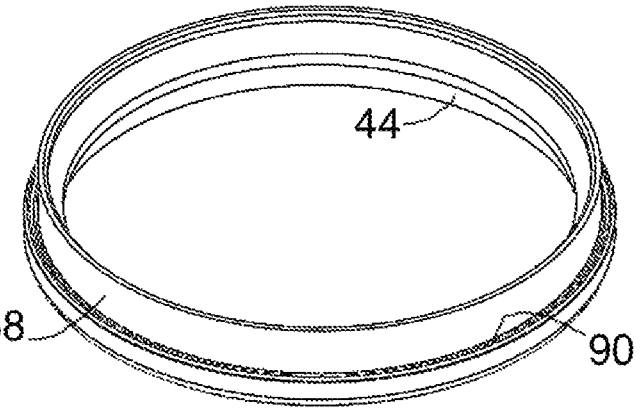
Fig. 8
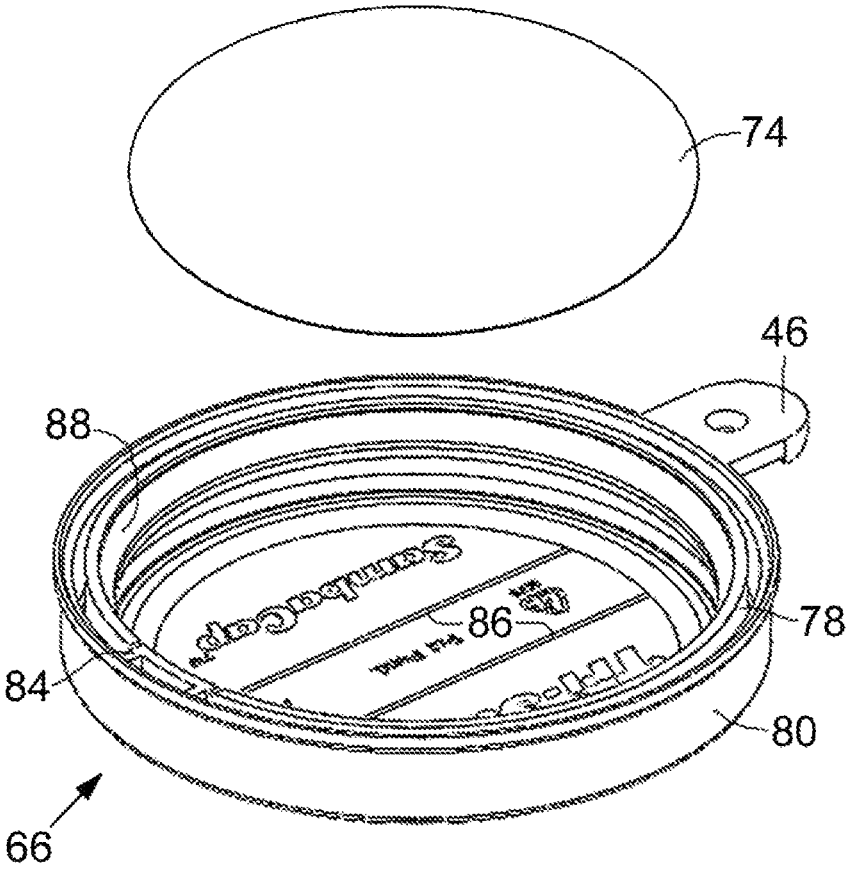

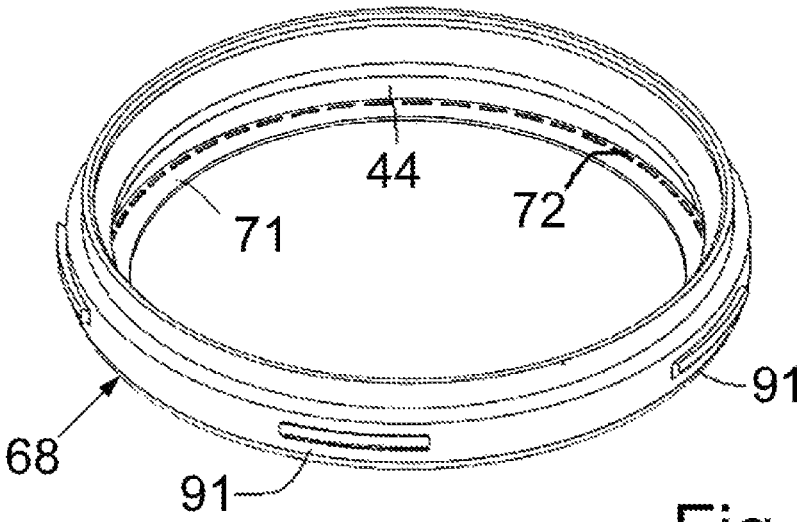
Fig. 10
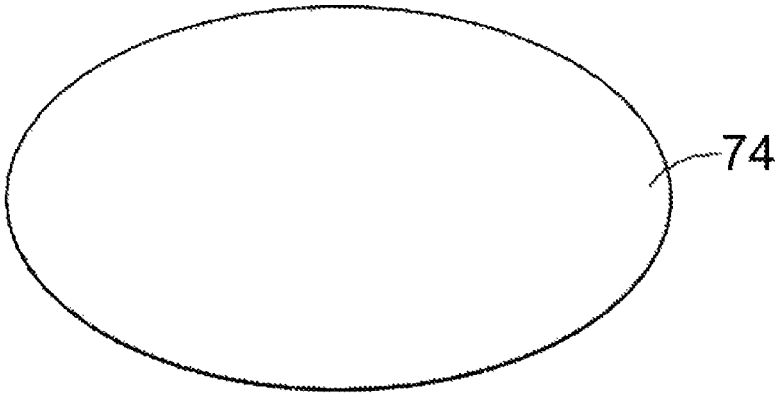
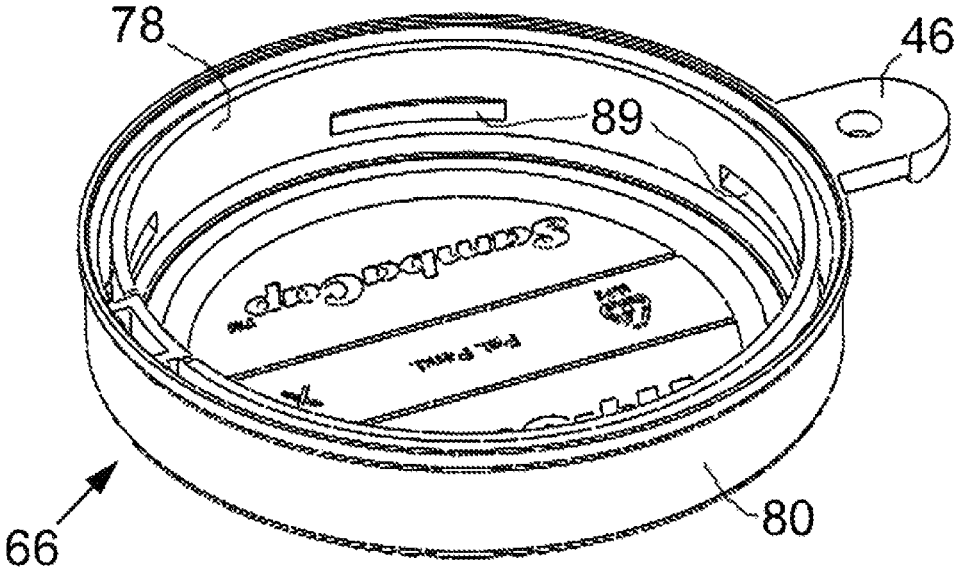

CLOSURE CAPS

CROSS-REFERENCE TO RELATED APPLICATIONS

This application is a National Stage of International patent application PCT/EP2016/058675, filed on Apr. 19, 2016, which claims priority to foreign Great Britain patent application No. GB 1506691.3, filed on Apr. 20, 2015, the disclosures of which are incorporated by reference in their entirety.

FIELD OF THE INVENTION

This invention is directed to caps or overseals for container closures and is principally, but not exclusively, directed towards closure caps or overseals for closure plugs for shipping containers; such as drums.

BACKGROUND

It has long been the practice to apply overseals of one kind or another with special hand and power tools which were able to crimp a metal portion of the overseal tightly around an upstanding opening neck designed to receive the seal. The application step itself is quite labour intensive and relatively inefficient. Consequently a number of hand applied overseals or closure caps have come forth which to a certain degree obviate the above-mentioned application tools. Our prior patent specifications WO2005/056411, WO2005/056412 and WO2008/139196 concern closure caps intended for application by hand, without the aid of special tools. To be effective such closure caps or overseals need to meet a number of rather demanding criteria. Obviously the hand application has to be simple and relatively effortless to satisfy normal filling line speeds. Once the drum or other container is shipped, of paramount importance is the ability of the cap or overseal to guard against unauthorized access to the drum contents. This means that ideally the cap or overseal cannot be physically removed without destroying it or making unauthorized access clearly noticeable such that the cap or overseal cannot be reapplied in unaltered form to the drum closure.

The caps or overseals must be of sufficiently robust construction so that they (and in particular their tamper indicating features) are not destroyed by the normal handling of the shipping containers or drums to which they are attached. Tamper indicating features which are destroyed or damaged in this way will give a false positive tamper indication. A performance criterion also of major importance is the ease with which the cap or overseal can be removed from the underlying container (e.g. drum) closure in an authorised manner such that subsequent replacement of the overseal is not possible. As this requires destruction of the cap or overseal in some fashion to prevent reuse this therefore to some extent conflicts with the requirement for robustness. In this regard the use of sharp cutting or puncturing implements is undesirable due to the likelihood injury or of accidental damage to the underlying closure. Thus, in addition to the overseal's robust construction, hand removability is yet another advantageous attribute.

WO2005/056411 and WO2008/139196 disclose closure caps intended for use together with specially modified complementary plastics closure plugs or bungs for shipping containers. The closure caps concerned have attachment portions which engage with an undercut groove formed in specially modified wrench-engaging lugs integrally moulded in the plug. WO2005/056412 discloses a closure cap which is suitable for application to the neck of a filling opening formed in metal, of the kind commonly found in metal shipping containers such as metal drums. As such it may therefore be used for tamper indicative protection of either plastics or metal closure plugs installed in such metal drums.

It is known to apply sealing foils to drum closure plugs, as disclosed in Indian patent application nos. 0814CHE2010 and 2809CHE2009. However according to those disclosures the foil application step takes place on the filling line, after the containers are filled and closed. The foil application step is a relatively slow process unsuited to automated filling lines. Checking for and remedying defective foils may also be problematic.

SUMMARY OF THE INVENTION

The present invention provides, preassembled or as a kit of parts:

(a) a support ring comprising a radially inwardly directed lip comprising an upwardly facing shoulder engageable in a groove or recess formed about a container opening, the support ring having:

(i) a masking membrane sealed at its periphery to the support ring, and/or (ii) an inwardly extending flange or an inwardly extending projection frangibly attached to the support ring;

and (b) a closure plug receivable in the container opening;

wherein, with the upwardly facing shoulder so engaged and the plug so received, the masking membrane and/or the inwardly extending flange and/or the inwardly extending projection overlap(s) the upper end of the plug.

For example the masking membrane may comprise a metal or otherwise electrically conductive foil, induction heat sealed to the support ring. The foil may cover up the upper end of the plug with the upwardly facing shoulder so engaged and the plug so received. Thus the masking membrane (where present) must be torn open to reach the wrench-engaging projection, thereby providing a first tamper indication; and/or unscrewing the plug breaks the frangible connection between the support ring (which remains attached to the container neck) and the inwardly extending flange or projection (where present).

For added protection, the preassembly or kit of parts may further comprise:

(c) an outer cover comprising a circumferential skirt having an inner, upwardly facing shoulder snap-fittingly engageable beneath an outer, downwardly facing shoulder provided about the support ring.

The outer cover may itself comprise tamper evidencing features, for example per se similar to those of the closure cap disclosed in WO2005/056412.

Thus the outer cover may comprise:

ca) a top wall;

cb) a skirt depending from the top wall;

cc) a tamper-detecting band radially spaced from and overlying the skirt;

cd) a frangible connection between the tamper-detecting band and the skirt;

ce) a line of weakness extending up the skirt and into the top wall, and cf) a bridging element securely joining the tamper-detecting band and the skirt in the region of the line of weakness.

When the container closure plug, closure cap and outer cover combination is applied to a container neck upstanding from a container wall, preferably a free lower edge of the tamper-detecting band lies in close proximity to the container wall.

The support ring and masking membrane (if used, and outer cover, if used) may be snap-fitted to the container as a preassembly in a single rapid step, thereby avoiding the encumbrances and delays associated with carrying out the foil welding and concomitant quality assurance operations in situ at the filling line.

BRIEF DESCRIPTION OF THE DRAWINGS

The above and further features of the present invention are illustrated, by way of example, with reference to embodiments further described below with reference to the drawings, in which:

FIG. 4 is an exploded perspective view of a support ring, masking membrane and outer cover which form components of the assembly shown in FIG. 3;

FIG. 8 is an exploded view corresponding to FIG. 3 but seen from a different viewpoint and showing a different form of support ring;

FIG. 10 corresponds to FIG. 3, but is shown from a different viewpoint and shows a different form of outer cover and support ring;

DETAILED DESCRIPTION

The closure plug 10 shown in connection with the illustrative embodiments of the invention (see e.g. FIG. 5) has a cup-shaped metal body deep drawn from suitable metal such as mild steel or stainless steel. The mild steel may be passivated and/or lacquered to confer the necessary corrosion resistance. An external thread is rolled onto the side wall of the cup-shaped body. A wrench-engaging insert 14 is stamped from the same metal, bent to shape and spot welded to the generally flat bottom wall within the cup-shaped body 12, so as to project upwardly therefrom. A suitable sealing washer or gasket is applied to the plug, immediately beneath an out-turned rim (60, FIG. 6) at the free upper end of the plug side wall. Alternatively, in unillustrated embodiments, the plug may be formed from plastics, or from any other suitable material or combination of materials. All of these processes may be conventional as such.

Figure 1:
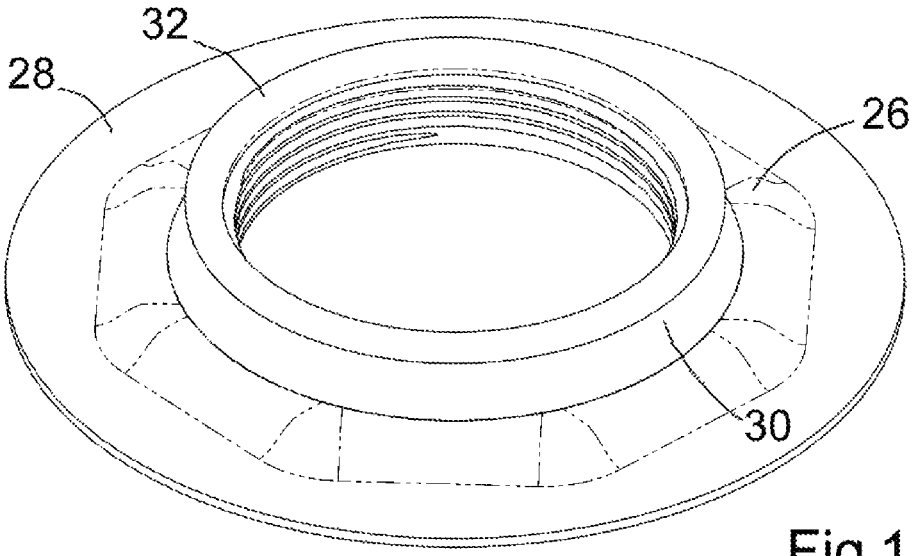
FIGS. 1 and 2 are perspective views from above of different container openings with inserted threaded flanges.

The plug thus formed may be a G2 plug, suitable for fluid tight closure of an opening in a shipping container or drum provided with a two inch (50.8 mm), internally threaded flange insert as specified in BS ISO 15750-3:2002. Such a container opening is shown in FIG. 1. Alternatively and not exclusively, the plug may be a G3/4 plug, suitable for a ¾ inch (19 mm) flange insert as specified in BS ISO 15750-3:2002 and illustrated in FIG. 2 installed in a drum end or side wall. Indeed the invention may be used with any suitable standard or non-standard container plug and container opening.

Figure 2:
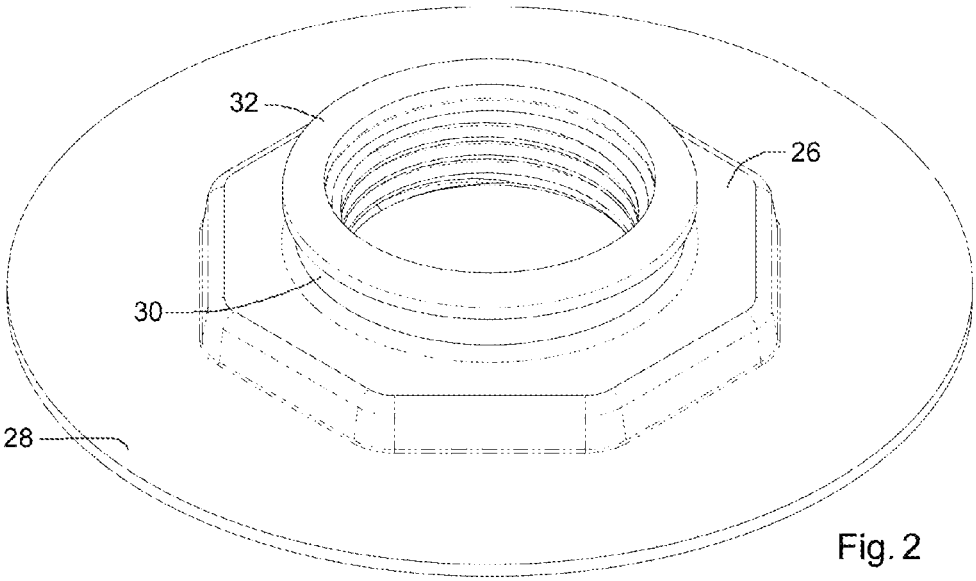
Figure 5:
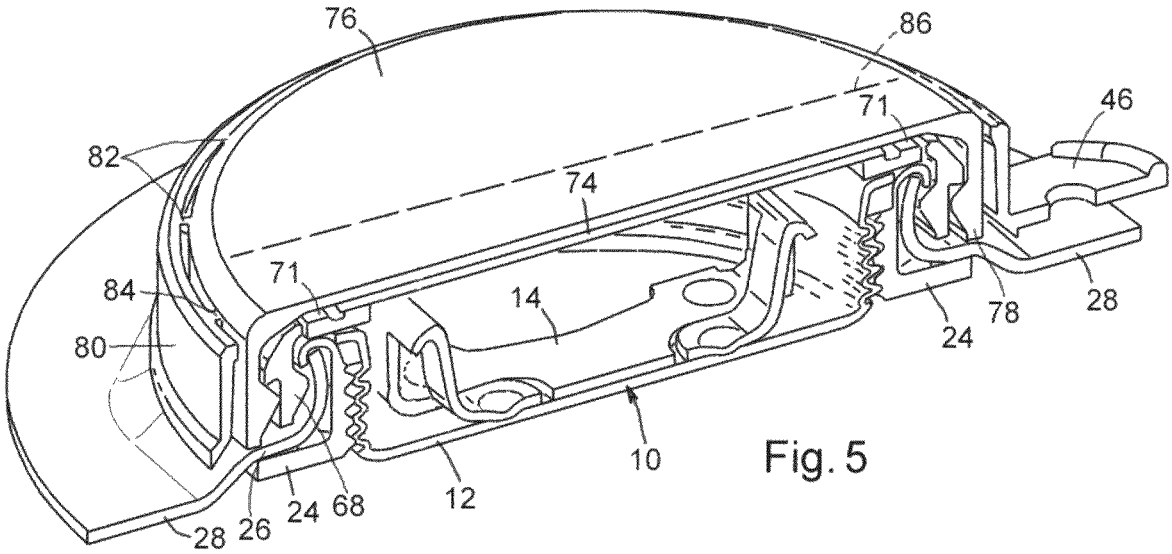
FIG. 5 is a cross-sectioned perspective view of the assembly of FIG. 3, including a container closure plug.

As shown in FIGS. 1, 2 and 5, the flange insert has an octagonal base flange (24, FIG. 5) non-rotatingly received in a complementary octagonal pocket 26 embossed into the drum end wall or head 28. The material of the drum wall surrounding the container opening is upset to form a collar 30 (see FIG. 6). The upper end 32 of the flange insert is curled outwardly and downwardly over the upper end of the collar to trap the flange insert in the opening. A suitable sealing washer or washers is/are inserted between the flange insert and the pocket 26 and/or collar 30.

Figure 3:
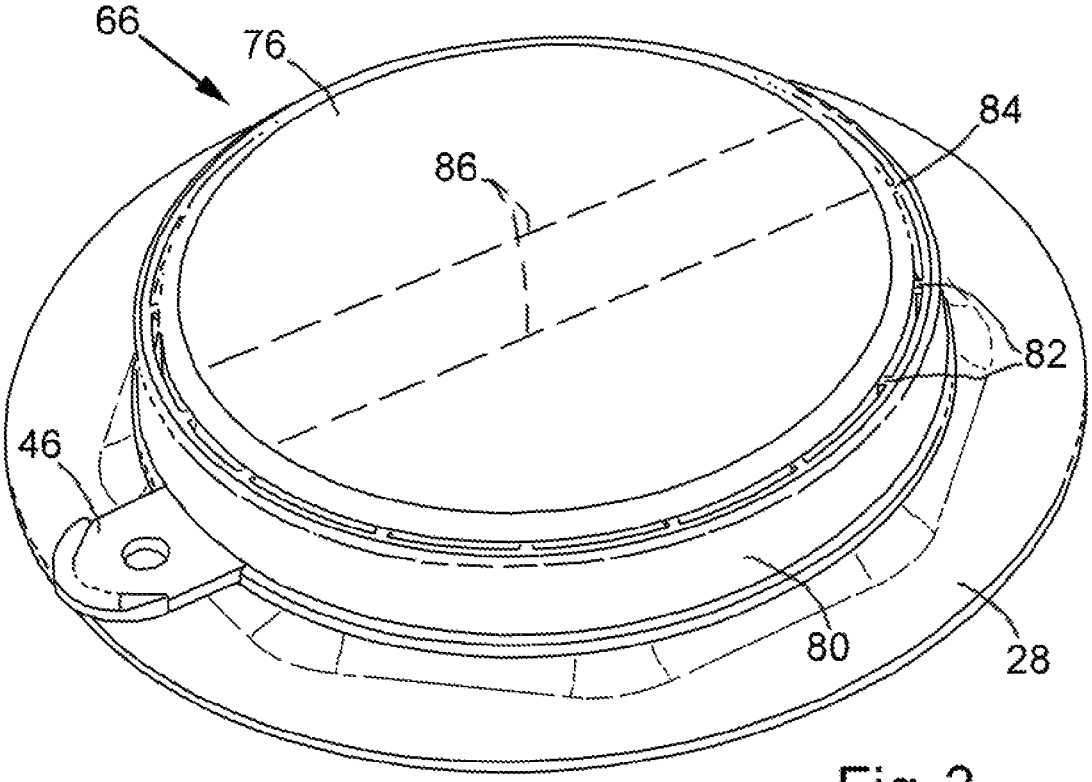
FIG. 3 is a perspective view from above showing components embodying the kit or preassembly, assembled and applied to the container opening shown in FIG. 1.

FIG. 3 shows a tamper-indicating cap assembly in place over a G2 plug and flange closure set in a drum head 28. The only component of the assembly visible in FIG. 3 is the outer cover 66, which may be substantially identical to the closure cap disclosed in WO2005/056412 as regards its general form and tamper evidencing features. The outer cover 66 thus comprises a top wall 76, a skirt 78 (see FIGS. 5 and 6) depending from the top wall and provided with an inner ridge 88, a tamper-detecting band 80 radially spaced from and overlying the skirt, a frangible connection (breakable bridges 82) between the tamper-detecting band and the skirt 78, two parallel lines of weakness 86 extending up the skirt and into the top wall 76, and bridging elements or webs 84 securely joining the tamper-detecting band 80 and the skirt 78 in the region of the lines of weakness 86. Instead of the webs 84, the bridging portion may comprise a circumferentially extending permanent link between the lower edges of the band 80 and top wall skirt 78, between the lines of weakness 86. A manually graspable tearing tab 46 protrudes outward from a lower edge of the tamper-detecting band 80. The lines of weakness 86 extend upwardly through the skirt 78 and inner ridge 88 of the outer cover 66, from either side of the bridging elements 84; their other ends terminating in the cap top wall 76 adjacent to tear tab 46. The lines of weakness define a tear strip between them. The lines of weakness 86 are preferably respective grooves formed in the inner surfaces of the top wall skirt 78 and the top wall 76, so as to leave a frangible membrane at the outer surface of the skirt 78 and top wall 76. The outer surface of the outer cover 66 can thus be smooth and uninterrupted. This is hygienic and allows the outer cover 66 to protect the container opening, masking membrane 74 (where present) and plug 10 from dirt and splashes, such as rainwater and sea spray. It is also easy to apply printed or similar material to the smooth surface, such as trade marks, or identification information or usage instructions for the container contents.

FIG. 4 shows a slightly modified form of the outer cover 66 compared to FIG. 3. The cover 66 in FIG. 3 has an extra tab **46*a* attached to the tamper-detecting band 80, diametrically opposite to tear tab 46. Tab 46*a* has an aperture by which it may be tied by a security seal to a security eye attached to the container neck. One of the tabs 46, 46*a*** may be removable, e.g. by breaking it off along a line of perforations or similar line of weakness (not shown) provided at or near its root.

FIG. 4 shows the outer cover 66 and further components of the assembly, namely the support ring 68 and an optional, inductively heatable masking membrane, foil or wad 74 (hereafter "masking membrane", for simplicity). The support ring 68 comprises an annular flange 71 connected to the rest of the support ring 68 by frangible links 72. The support ring 68 is preferably produced as a one-piece injection moulding of soft synthetic plastics resin, such as LDPE. The masking membrane 74 may carry graphics such as trade marks, or identification or usage information about the container contents. It may also include security features such as holograms, making it difficult to replicate. The masking membrane 74 (if present) is secured about its periphery, by induction heat sealing or by any other suitable method, to the annular flange of the support ring 68, conveniently before the protective cap preassembly is shipped to drum/container fillers for application to container closure plugs and grooved container openings. This top surface may be radially inward or radially outward of the frangible links 72; i.e. the masking membrane 74 may be attached to either the annular flange 71 or to the rest of the support ring 68.

Figure 6:
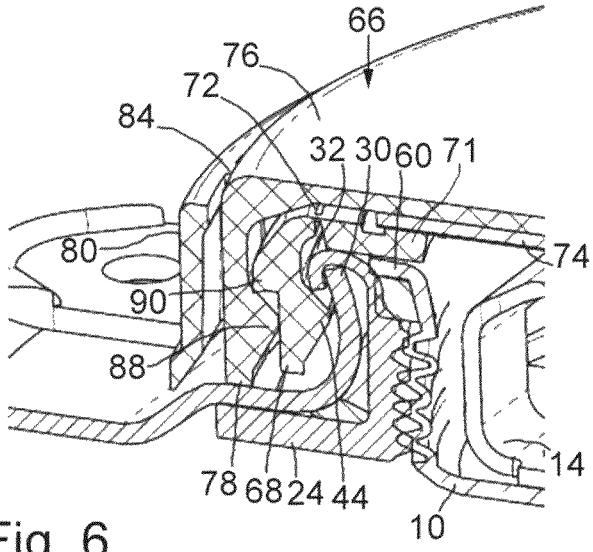
FIG. 6 is a view of details taken from FIG. 5, drawn to a larger scale.

The support ring 68 and attached masking membrane 74 (if used) are then snap-fitted into the outer cover 66 (if used), with the masking membrane innermost, as shown in FIGS. 5 and 6. These assembly steps may be carried out by the closure cap manufacturer away from the container filling line. The resulting cap assemblies are just as quick and easy to fit to the container closures as the previously described tamper-indicating closure caps. They can also be subjected to quality control checks, e.g. to guarantee that the masking membranes are properly attached in all closure caps shipped to the drum filler.

As best shown in FIG. 6, the inner annular ridge 88 of the outer cover skirt 78 snaps over an outer annular bead 90 provided near the top of the support ring 68, to hold the outer cover 66 thereon. The support ring 68 comprises an inner surface formed as a radially inwardly directed lip 44 comprising an upwardly facing shoulder, for engagement beneath the flange insert upper end curl 32, next to the drum end wall collar 30.

Referring to FIGS. 5 and 6, it can be seen that when the support ring 68 and outer cover 66 assembly is applied over the plug 10 and container opening, the lip 44 on the inner surface of the support ring 68 snaps past the curled over upper end 32 of the flange insert 24. The lip 44 is thereby substantially permanently locked in position in the groove below the curled over upper end 32, adjacent to the drum end collar 30 (i.e. the support ring is difficult to remove from around the container opening without cutting or breaking it or the container opening). The support ring 68 is therefore secured externally around the drum end collar 30 and flange insert curl 32 by the lip 44. In this position, the lower edge of the top wall skirt 78 lies closely adjacent to and ideally in contact with the underlying octagonal embossment or pocket 26. It is therefore difficult to insert an implement such as a knife or screwdriver between the embossment and the skirt lower edge in an attempt to pry the outer cover 66 and support ring 68 off the collar 30 and insert curl 32. Any such attempt is likely to result in visible damage to the top wall skirt 78 and/or tamper indicating band 80 lower edges, and/or breakage of the frangible connections 82.

The support ring 68, especially if made from a relatively soft material, can make a good seal with the flange insert upper end curl 32 and the plug rim 60. Together with the sealing foil 74, it therefore protects the plug interior from moisture, corrosion and dirt accumulation. The outer cover 66, when used, provides similar protection, as well as additional mechanical protection to the container neck and plug, as well as to the support ring, and masking membrane (if used).

Figure 7:
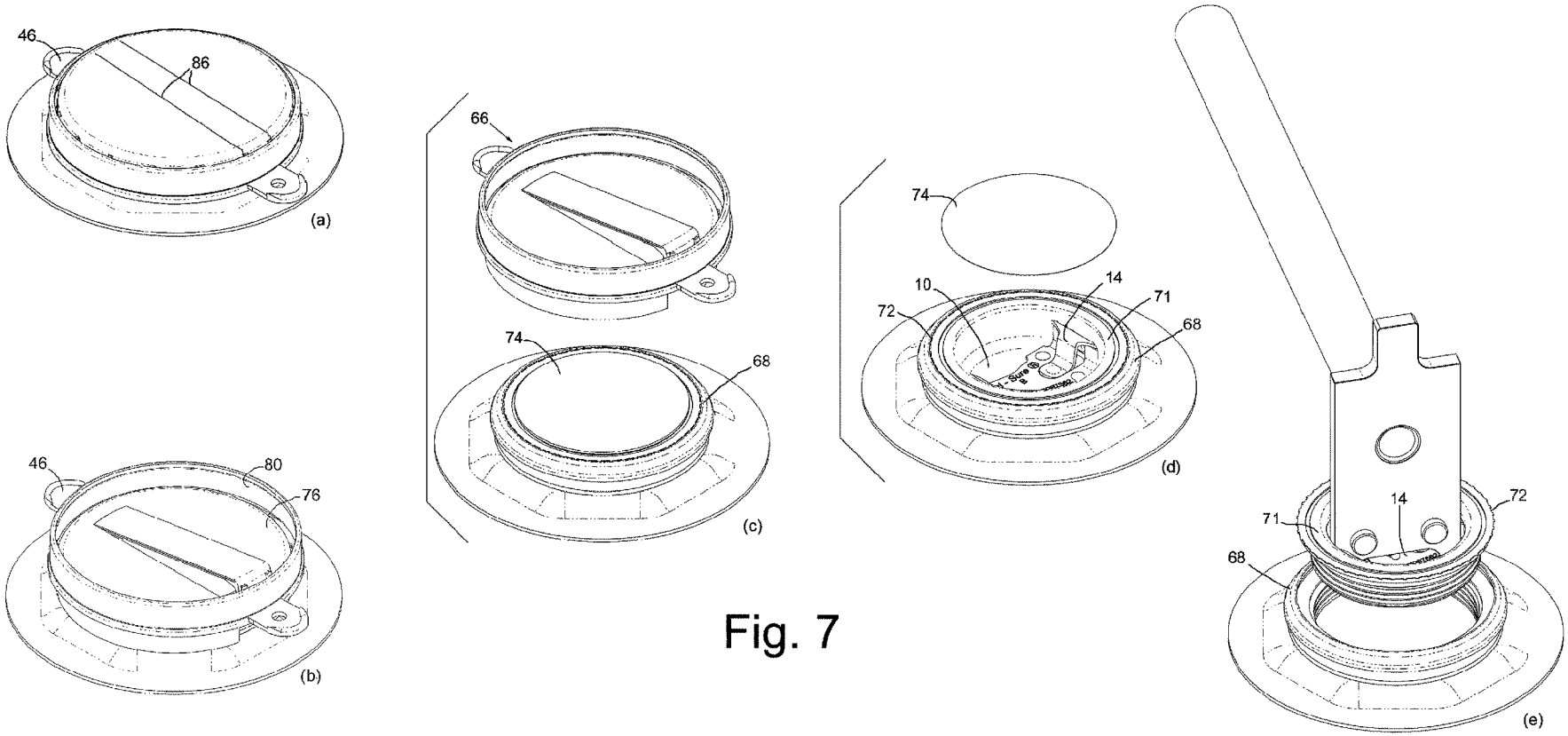
FIG. 7 shows a closure cap removal sequence for the assembly of FIG. 5.

The steps for removal of the tamper-indicating cap assembly illustrated in FIGS. 3, 5 and 6 from a drum closure to which they have been fitted, are shown in FIG. 7. The tear tab 46 is grasped first of all (panel (a)). Lifting the tear tab 46 breaks the frangible links 82, freeing the tamper-detecting band 80 from the top wall skirt 78, except for the bridging element 84. The freed band 80 may then be used as a handle to rupture the lines of weakness 86, initiating the tear at the bridging element 84. A tear strip is thus torn out of the outer cover skirt 78 and across the outer cover top wall 76. The outer cover top wall 76 is almost bisected in the process (panel (b)), so that the inner annular ridge 88 of the cover skirt 78 becomes loose and can easily be removed from beneath the annular bead 90. The entire outer cover 66 can now be lifted away, ruptured but still in one piece (panel (c)). This exposes the masking membrane 74 (if used). Then as schematically shown in panel (d), the masking membrane 74 may be removed or breached, allowing wrench access to the wrench-engaging insert 14, for removal of the plug 10. The flange 71 or other frangibly attached projection(s) (where present) project(s) above and cover(s) the rim 60 of the plug 10 when the support ring is snapped over the container neck 30. The central aperture bounded by the flange 71 permits access to the wrench engaging insert 14 of the plug. Removal of the plug 10 (panel (e)) breaks the frangible links 72 or other line of weakness, because as the plug rises its rim 60 pushes against the annular flange 71 or other frangible projection(s) and the rest of the support ring 68 remains captive on the drum head collar 30, beneath the flange insert top curl 32.

The tamper-indicating cap assembly of FIGS. 3-7 is therefore able to provide individually selectable and/or multiple levels of tamper-resistive security. Attempted levering off of the outer cover 66 (if used) is liable to damage the tamper-detecting band 80 and/or break the frangible links 82. The lower edges of the band 80 and outer cover skirt 78 are positioned against or very close to the octagonal embossment 26, so that gaining a purchase for such levering off is difficult. Removal of the outer cover 66 in the legitimate way (i.e., as intended) results in its clearly visible destruction. A missing or damaged masking membrane 74 (if used) also indicates that tampering may have occurred. Finally, broken frangible links 72 or projections (including but not limited to a completely missing flange 71 or other frangibly attached projection) in the case of using the flange 71 or projection(s), indicate that the plug 10 may have been breached.

Figure 9:
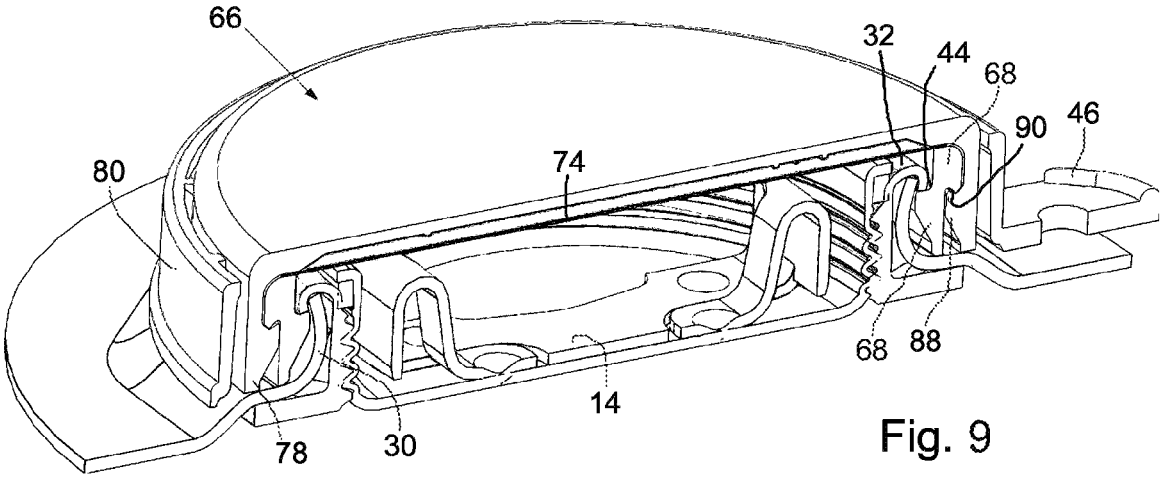
FIG. 9 shows the closure cap assembly of FIG. 8 fitted to a container closure.

FIG. 8 is an exploded perspective view showing another set of components forming a closure cap assembly. The assembly again comprises a support ring 68 having a moulded lip 44 on its inside, snap-engageable over the curled over upper end 32 of a flange insert, or over a similar external ridge defining a groove about a container neck (see FIG. 9). The support ring 68 has a masking membrane 74 induction heat sealed or otherwise peripherally bonded to it. The annular flange 71 described with reference to the preceding embodiment is omitted in this embodiment. The support ring again has an outer annular bead 90 for trapping an inner annular ridge 88 provided on the skirt 78 of an outer cover 66 (see FIG. 9). This cover again may be substantially as shown in WO2005/056412 in its general form and tamper evidencing features, although again the outer cover is optional, or any other suitable removable cover can be used; preferably one that provides tamper evidence on removal. Access to the wrench-engaging insert 14 is therefore achieved as shown and described above with reference to FIG. 7 above; except that because there is no annular flange 71, removal of the sealing foil provides the only indication that the plug 10 has been accessed and may have been removed.

In a variant of the embodiment of FIG. 7, the sealing foil may be omitted, such that breaking of the frangible connection 72/removal of the annular flange 71 or projection provides the only indication that the plug may have been accessed or removed. Whether or not a sealing foil is provided, rather than an annular flange 71, the support ring may be provided with one or more frangibly mounted projections, extending inwardly to at least partially overlap the plug 10, e.g. extending above the plug rim 60 (see FIG. 6), so as to still permit access to the wrench-engaging insert 14. Removal of the plug will break off the projection(s) in a similar way to how the previously described annular flange 71 is broken off. The annular flange 71 or projection(s) may have a downwardly turned free end (not shown), which follows the contours of the plug lip at least part way down the inner surface of the plug side wall. The annular flange 71 or projection(s) may be used either with or without a masking membrane 74.

FIG. 10 generally corresponds to FIG. 4, except that the outer annular bead 90 on the support ring 70 is interrupted to form a coplanar series of arcuate ribs 91 engageable within a complementary series of recesses 89 in the outer cover skirt 78. These or functionally similar features (e.g. a circumferential rib/groove with one or more complementary keys/slots at particular azimuthal orientations) can be used to ensure that the support ring 68 and masking membrane 74 are in a fixed angular orientation relative to the outer cover 66. Therefore if the outer cover, support ring and masking membrane are snap-fitted to the flange insert curl 32 as a unitary preassembly in a particular orientation (e.g. determined by aligning the tear tab 46 in a particular direction relative to the drum), any text or graphics on the masking membrane can likewise be disposed in a particular orientation relative to the drum.

Figure 11:
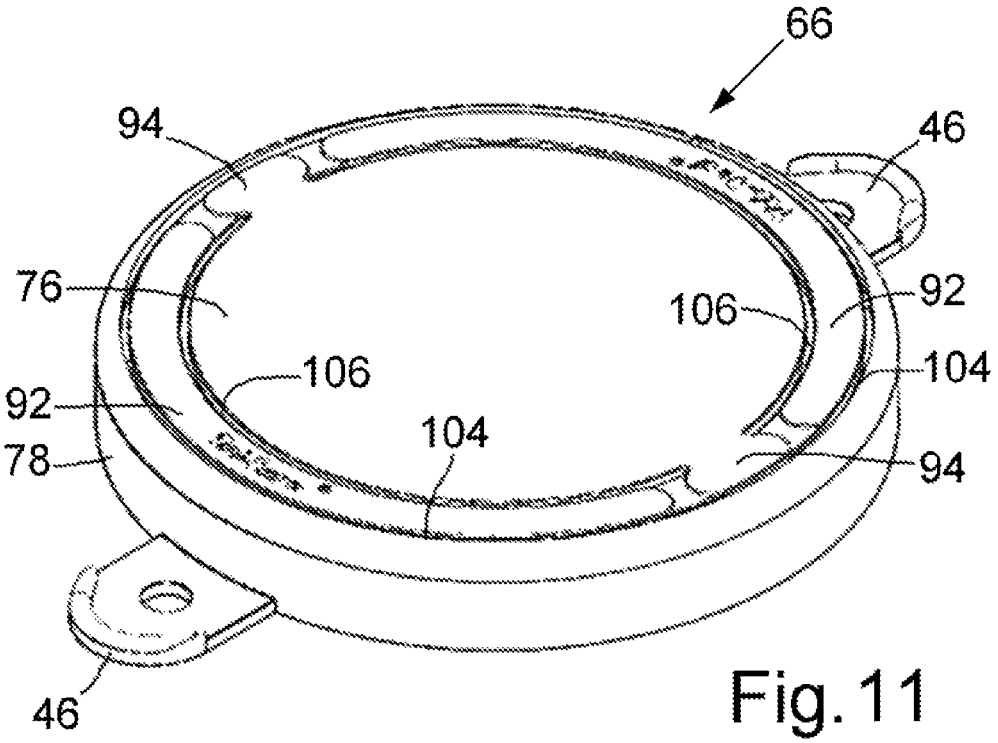
FIGS. 11 and 12 show an alternative forms of outer cover.

The outer cover may take any suitable form, and is not limited to the form shown in FIGS. 3-7. Indeed, e.g. where the masking membrane 74 is sufficiently robust for the intended use of the container and container closure, the outer cover may be omitted altogether. FIG. 11 shows a modified form of the outer cover 66, so as to provide bail handles 92 as well as the annular skirt 78. The tamper-detecting band may be omitted as shown, or it may be included, mounted to the skirt 78 by the breakable links 82 or other suitable frangible connection(s). The bridging elements 84 are in this case unnecessary and may be omitted. The outer cover skirt 78 engages with the support ring 68 in the same way as it does in the closure cap shown and described with reference to FIGS. 3-7. The skirt 78 is delineated from the bail handles 92 and their mounting ears 94 by a circular slot 104. This is spanned by frangible links (not shown) connecting the skirt 78 to the ears 94 and/or to the bail handles 92. Raising the bail handles therefore breaks any frangible links between them and the skirt 78 and between them and the outer cover top wall 76. An upward pull on the bail handles will then break any frangible links between the ears 94 and the skirt 78. The top wall 76 can then be removed for access to the masking membrane 74 (if used) and wrench-engaging insert 14. The skirt 78 can remain in place about the drum end collar 30 during and after this procedure. The skirt 78 and/or the support ring where used in any embodiments of the invention, may remain permanently attached to the container neck, to act as a tamper warning sign after other components of the cap assembly (e.g. the outer cover top wall and/or masking membrane 74) have been removed. Rather than the bail handles 92 and ears 94, any other suitable tear strip or tear strips may be provided in the outer cover to permit removal of the top wall 76 (or sufficient of it to permit the required access to the masking membrane 74 and/or wrench engaging insert 14).

Figure 12:
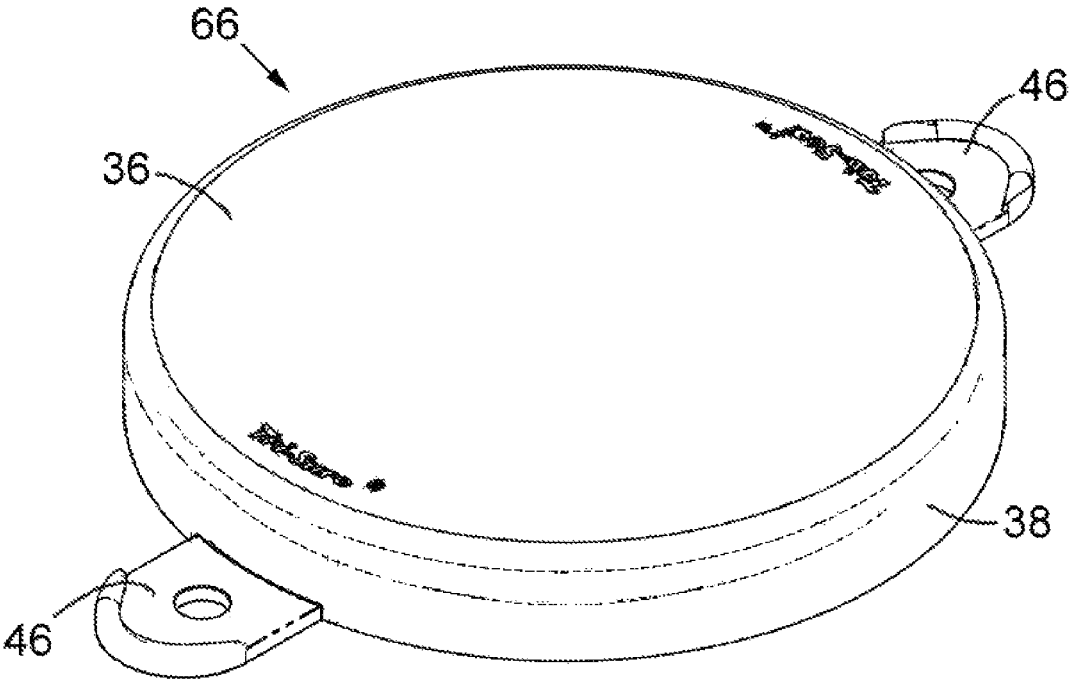
Figure 13:
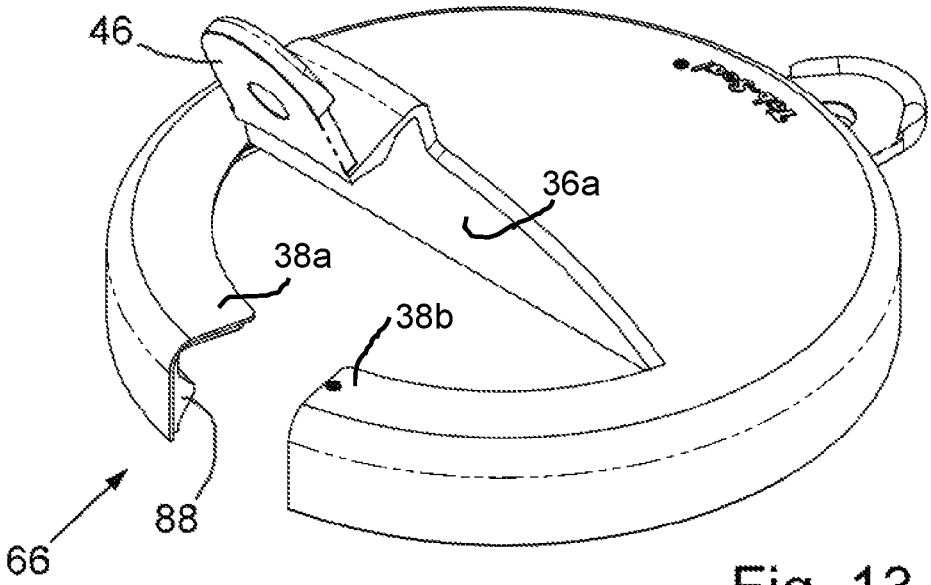
FIG. 13 shows the cover of FIG. 12 in the process of removal.

FIGS. 12 and 13 show yet another modified form of the outer cover 66. It is injection moulded in one piece from a suitable synthetic plastics resin such as HDPE. The top wall 36 carries at its outer edge a depending annular skirt 38. An inner surface of the skirt 38 is provided with a moulded ridge 88 (see FIG. 13) for reception beneath the support ring outer annular bead 90. A pair of manually graspable tearing tabs 46 protrude outward from a lower edge of the skirt 38, along a diameter of the outer cover 66. To either side of each tear tab 46, a line of weakness extends upwardly through the skirt 38 and ridge 88; then radially inwardly a short distance across the top wall 36 and then circumferentially away from its respective tear tab, terminating short of the diameter of the outer cover which bisects the tear tabs 46. The lines of weakness are preferably respective grooves formed in the inner surfaces of the annular skirt 38 and the top wall 36, so as to leave a frangible membrane at the outer surface of the skirt and top wall. The grooves are therefore not visible in FIG. 12. The outer surface of the outer cover 66 can therefore remain smooth and uninterrupted. This is hygienic and allows the cover to protect the container opening and plug 10 from dirt and splashes, such as rainwater and sea spray. It is also easy to apply printed or similar material to the smooth surface, such as trade marks, or identification information or usage instructions for the container contents. The outer cover 66 also provides mechanical protection to the masking membrane 74.

The lines of weakness at one side of the outer cover 66 are ruptured by grasping one of the tear tabs 46 and pulling upwardly and inwardly (FIG. 13). This also hinges upwardly a segment 36*a* of the cover top wall 36 bordered by the lines of weakness. For this purpose, a living hinge may be moulded into the underside of the cover top wall, as a straight groove (not shown) extending between the inner ends of the pair of lines of weakness associated with each tab 46. Upward hinging of the cover top segment frees the adjacent skirt portions 38*a*, 38*b* so that they can bend outwardly to free the moulded ridge 88 from beneath the support ring outer annular bead 90. The tamper indicating outer cover 66 is thus removed from over the plug 10 and container opening. The tamper-indicating outer cover 66 is destroyed by such removal and cannot be reapplied to the container without acting as a tell-tale that the plug 10 has been accessed. After removing or breaching the masking membrane 74, the wrench-engaging insert 14 is accessible by a wrench, for unscrewing and removing the plug 10.

Although various features have been described above in particular combinations in particular embodiments, this is only for the purposes of illustration and is not limitative. Any feature described in relation to any embodiment may be used together with or in substitution for an equivalent feature of a different embodiment, or may be omitted, where technically compatible. Other modifications are possible within the scope of the invention as defined by the claims.

The invention claimed is:

1. Preassembled or as a kit of parts:

(a) a support ring comprising a radially inwardly directed lip comprising an upwardly facing shoulder engageable in a groove or recess formed about a container opening, the support ring having:

(i) a masking membrane sealed at its periphery to the support ring, and/or (ii) a frangibly attached inwardly extending member; and (b) a closure plug receivable in the container opening; wherein, with the upwardly facing shoulder engaged in the groove or recess and the plug received in the container opening, the masking membrane and/or the inwardly extending member overlap(s) the upper end of the plug, wherein the preassembly or kit further comprises:

(c) an outer cover comprising a circumferential skirt having an inner, upwardly facing shoulder snap-fittingly engageable beneath an outer, downwardly facing shoulder provided about the support ring so as to cover up and prevent access to the masking membrane (where present) and so as to cover up and prevent access to the inwardly extending member (where present).

2. The preassembly or kit as claimed in claim 1 comprising the masking membrane, and in which the masking membrane comprises an electrically conductive foil.

3. The preassembly or kit as claimed in claim 1 comprising the masking membrane, and in which the masking membrane is sealed at its periphery to the support ring prior to engagement of the upwardly facing shoulder in the groove or recess.

4. The preassembly or kit as claimed in claim 1 comprising the masking membrane, and in which the masking membrane covers up the upper end of the plug when the upwardly facing shoulder is engaged in the groove or recess and the plug is received in the container opening.

5. The preassembly or kit of claim 1, in which the outer cover comprises:

ca) a top wall;

cb) a skirt depending from the top wall, cc) a tamper-detecting band radially spaced from and overlying the skirt, and cd) a frangible connection between the tamper-detecting band and the skirt.

6. The preassembly or kit of claim 5, in which the outer cover comprises:

ce) a line of weakness extending up the skirt and into the top wall, and cf) a bridging element securely joining the tamper-detecting band and the skirt in the region of the line of weakness.

7. The preassembly or kit of claim 1, in which the outer cover comprises a line of weakness defining a removable top portion.

8. The preassembly or kit of claim 1, in which the outer cover comprises a line of weakness which is breakable to permit removal of the outer cover from the support ring.

* * * * *